US006417155B1

(12) United States Patent
Zhou et al.

(10) Patent No.: US 6,417,155 B1
(45) Date of Patent: Jul. 9, 2002

(54) LAUNDRY BARS COMPRISING NON-STAINING WATER SOLUBLE POLYMERIC COLORANTS

(75) Inventors: Zhaolin Zhou; Tiong Khoon Ong, both of Singapore (SG)

(73) Assignee: Milliken & Company, Spartanburg, SC (US)

( * ) Notice: Subject to any disclaimer, the term of this patent is extended or adjusted under 35 U.S.C. 154(b) by 159 days.

(21) Appl. No.: 09/662,785

(22) Filed: Sep. 15, 2000

(51) Int. Cl.[7] ..... C11D 17/00; C11D 17/06

(52) U.S. Cl. ..... 510/445; 510/446; 510/447; 510/505; 510/506; 8/647

(58) Field of Search ..... 510/445, 446, 510/447, 505, 506; 8/647

(56) References Cited

U.S. PATENT DOCUMENTS

| | | | | | |
|---|---|---|---|---|---|
| 3,755,201 | A | * | 8/1973 | Trimmer et al. | 252/526 |
| 3,958,928 | A | * | 5/1976 | Lala | 8/25 |
| 4,110,238 | A | * | 8/1978 | Lala | 252/89 |
| 4,543,204 | A | | 9/1985 | Gervasio | 252/531 |
| 4,721,581 | A | | 1/1988 | Ramachandran et al. | 252/135 |
| 5,041,243 | A | | 8/1991 | Joshi | 252/534 |
| 5,043,091 | A | | 8/1991 | Joshi et al. | 252/174.17 |
| 5,053,159 | A | | 10/1991 | Joshi | 252/106 |
| 5,069,825 | A | | 12/1991 | Joshi et al. | 252/533 |
| 5,952,289 | A | | 9/1999 | Wise et al. | 510/450 |

* cited by examiner

*Primary Examiner*—Necholus Ogden
(74) *Attorney, Agent, or Firm*—Terry T. Moyer; Williams S. Parks

(57) ABSTRACT

Colored detergent bars are provided comprising water soluble polymeric colorants that exhibit excellent non-staining performance on fabrics and other contacted surfaces, including manufacturing and/or washing equipment, are easy to process into the desired detergent bar compositions, and do not exhibit any appreciable harmful effects to the environment. The particular polymeric colorants utilized in this respect are of very high molecular weight (in order to assure staining will not occur on target cleaning surfaces), are extremely water soluble, provide excellent vivid and aesthetically pleasing color shades within the target bar compositions, and are present as liquid or waxy pastes at room and at processing temperatures. The ultimate laundry bar product thus exhibits highly pleasing colors for product distinction as well as for aesthetic purposes.

20 Claims, No Drawings

LAUNDRY BARS COMPRISING NON-STAINING WATER SOLUBLE POLYMERIC COLORANTS

FIELD OF THE INVENTION

This invention relates to colored detergent bars comprising water soluble polymeric colorants that exhibit excellent non-staining performance on fabrics and other contacted surfaces, including manufacturing and/or washing equipment, are easy to process into the desired detergent bar compositions, and do not exhibit any appreciable harmful effects to the environment. The particular polymeric colorants utilized in this respect are of very high molecular weight (in order to assure staining will not occur on target cleaning surfaces), are extremely water soluble, provide excellent vivid and aesthetically pleasing color shades within the target bar compositions, and are present as liquids or waxy pastes at room and at processing temperatures. The ultimate laundry bar product thus exhibits highly pleasing colors for product distinction as well as for aesthetic purposes.

BACKGROUND OF THE PRIOR ART

All U.S. Patents listed below are fully incorporated herein by reference.

Throughout much of the world, automatic washing machines are not prevalent. In order to regularly clean clothing, many people handwash their garments. Although powders and liquids comprising detergents and/or soaps may be utilized in such handwashing procedures, the standard cleaning compositions utilized for this purpose are in bar form. Laundry bars provide users the ability to more effectively scrub their target garments by permitting the user to concentrate friction and detergent simultaneously on a stained or soiled article of clothing. As such, laundry bars are more appropriate for handwashing procedures, particularly in comparison with powders and liquids, for obvious reasons. Examples of such laundry bars are present within the following U.S. Pat. No. 4,543,204 to Gervasio, U.S. Pat. No. 4,721,581 to Ramachandran et al., U.S. Pat. No. 5,041,243 to Joshi, U.S. Pat. No. 5,043,091 to Joshi et al., U.S. Pat. No. 5,053,159 to Joshi, and U.S. Pat. No. 5,069,825 to Joshi. Such laundry bars differ from household soap and/or personal cleansing bars in that the amount of detergent and/or soap concentrated therein is much greater than for household soaps, etc., alone. Thus, continuous application of such high soap and/or detergent-level laundry bars to human skin would most likely cause skin irritation.

As with most household products, it is highly desirable to provide laundry bars which can easily be identified (from both production source and detergent strength perspectives) and exhibit aesthetically pleasing appearances. One manner of providing such properties is to add color to the final product. Colored laundry bars have been produced, sold, and used in the past; however, such bars have included, primarily, pigments, as coloring agents. Pigments and dyestuffs contribute a number of problems for such laundry bars from processing difficulties to staining possibilities during use. For instance, in order to produce such laundry bars, milling and extrusion procedures are generally followed. The presence of pigments and/or dyestuffs within such machinery causes mechanical problems (due to higher viscosities, solid particles, and/or highly staining compounds) which must be compensated for in different ways. Pigments are generally provided in solid, small particles, which are difficult to handle and which may provide handling problems during production. Also, after the production of certain batches of specifically colored laundry bars, the machinery must be thoroughly cleaned to remove such highly staining pigments and/or dyestuffs (which may create off-color or speckled bars if they remain present during the milling and/or extrusion of a subsequent batch). Pigments do not easily wash away, generally, and thus such cleaning steps may require the utilization of organic solvent compositions which possess their own difficulties and potential problems. Dyestuffs generally require premix production that adds to the complexity of laundry bar production. Furthermore, the colorations provided by pigments are difficult to control from batch to batch (and thus uniform colorations are rather difficult to produce on an industrial scale). Dyestuffs are generally ionic in nature and thus are not readily compatible with other laundry bar constituents (such as surfactants, perfumes, preservatives, and the like). Pigments, dyes, and dyestuffs also comprise heavy metal components at times which provide environmental and health issues. Additionally, the general color appearances provided by pigments are dull due to the adsorption and scattering of light by the constituent solid particles.

Upon use of such pigment- and/or dyestuff-containing laundry bars, such coloring agents have been found to cause staining of the user's skin as well as upon the washboard and target garments themselves. Furthermore, most pigments include metals or other components which, upon introduction within wastewater from a washing procedure, have been known to cause environmental problems. Thus, it is important to provide a manner of coloring laundry bars which is easy to incorporate within standard milling and extrusion procedures, facilitates cleaning from such necessary machinery, fabrics, human skin, and other washing equipment, and which is environmentally friendly. To date, no improvements in the laundry bar industry have been accorded by the prior art.

OBJECTS AND BRIEF DESCRIPTION OF THE INVENTION

It is an object of the subject invention to provide colored laundry bars that exhibit substantially no staining on target fabrics, the user's skin, and the manufacturing equipment utilized to produce such laundry bars. It is a further object of the subject invention to provide colorants that have no heavy metal and have no dye dust involved in the manufacturing process and thereby are relatively easy to use and produce. It is yet a further object of this invention to provide a colored laundry bar exhibiting the above characteristics and which also exhibits stable and aesthetically pleasing colorations throughout the bar even after repeated use within an aqueous environment.

Accordingly, this invention encompasses a colored laundry bar comprising at least one compound selected from the group consisting of a soap, a detergent, a surfactant, a tenside, and any mixtures thereof, preferably in an amount of between about 25 and 80% by weight of the total weight of the bar, most preferably between about 30 and 60%, and at least one colorant present in an amount of from about 0.001 to about 2.0% by weight of the total weight of the bar, wherein said colorant is a water-soluble polymeric colorant having from about 3 to 50 moles of oxyalkylene constituents per polymer chain.

Such a specific colored laundry bar composition has never been produced or taught within the pertinent prior art. In fact, the belief has been in the past that such high molecular weight polymeric colorants could not function properly within laundry bar compositions due to the extremely high water solubility and liquid nature of the colorants themselves. Since the laundry bars are utilized within procedures which require a great deal of repeated contact with water, it is rather difficult to retain stable colorations throughout such laundry bars including these extremely water soluble polymeric colorants. Thus, previous attempts at incorporating the desired high molecular weight polymeric colorants within such solid laundry bars have either been unsuccessful or nonexistent until now.

DETAILED DESCRIPTION OF THE INVENTION

The particular high molecular weights and degree of oxyalkylation of the colorants within the inventive laundry bars are necessary to provide the desired low staining ability. Polymeric colorants in general have a propensity to color any surface to which they are contacted, adhered, or incorporated. The currently discussed polymeric colorants were developed to provide temporary, easily removable, but highly effective colorations to certain substrates, including fabrics, yams, liquids, and the like. These high molecular weight colorants do not readily react with substrates and are extremely water soluble. Thus, the colorants are, as noted above, easily removed from certain substrates through a simple aqueous rinsing procedure. The same holds true for human skin, metal surfaces, plastics, concrete, and other common substrates. As a result, such colorants do not exhibit any appreciable staining of target substrates cleaned through utilization of the inventive laundry bars.

The problem with utilizing such colorants as now taught is that the water solubility is difficult to control, particularly when the ultimate laundry bar composition comprises components of which a vast majority is water (e.g., soaps and detergents comprise or easily pull water from the atmosphere) and the bar is generally in constant contact with water during use. However, the colorants have been shown to remain quite stable in composition dispersed throughout the soap and/or detergent formulation of the laundry bar itself and thus do not exhibit any appreciable loss or alteration in color strength or shade.

The particularly preferred colorants defined above are produced by Milliken & Company and have been used solely in the past within liquid compositions, such as liquid detergents, liquid fabric softeners, liquid antifreezes, and the like. Again, the high molecular weight and extremely high water solubility of such colorants are much more appropriate for such liquid applications due to the ability to provide uniform, stable color throughout the target composition and yet not exhibiting any unwanted discolorations to target substrates upon use thereof. Such colorants have not been utilized as colorants within solid compositions to any appreciable degree, as noted above.

In particular, these colorants provide the laundry bar composition of the invention with improved resistance to staining of fabrics including one or more of cotton, wool, acetate, polyester, polyamide, acrylics and viscose so that all, or virtually all of the colorants will not be left on the fabric by means of normal handwashing procedures. Furthermore, such colorants exhibit superior brightness, are less toxic to humans due to relatively high molecular weight of the colorants and the lack heavy metals, as compared with dyestuffs and/or pigments. Additionally, these colorants are present as low viscosity liquids or waxy pastes (at room temperature, at least) and are thus much easier to handle than dyestuff and pigment solids and powders.

The particularly preferred colorants of this invention comply with the following structure (I)

$$R\{A[(B)_n]_m\}_x \qquad (I)$$

wherein

R is an organic chromophore;

A is a linking moiety in said chromophore selected from the group consisting of N, O, S, $SO_2N$, $SO_3N$, and $CO_2$;

B is an alkyleneoxy constituent contains from 2 to 4 carbon atoms;

n is an integer of from 12 to about 50;

m is from 1 to 4; and x is an integer of from 1 to about 5.

These colorants are highly water soluble due to the high degree of alkoxylation (from between 3 and 50 moles per polymer chain). Such oxyalkylene groups include ethyleneoxy (EO), propyleneoxy (PO), butyleneoxy (BO), and so forth. Furthermore, such colorants are, when present in their substantially pure, undiluted states, generally either liquid or waxy paste at room temperature. The organic chromophore is, more specifically, one or more of the following types of compounds: azo, diazo, disazo, trisazo, diphenylmethane, triphenylmethane, xanthene, nitro, nitroso, acridine, methine, styryl, indamine, thiazole (including benzothiazole), oxazine, stilbene, phthalocyanine, or anthraquinone. Preferably, R is one or more of azo, diazo (including, without limitation, phenyl-, naphthol-, benzothiazole-, and acid-based chromophores), triphenylmethane, methine, anthraquinone, or thiazole based compounds. Such a group may produce coloring effects that are evident to the eye; however, optical brightening chromophores are also contemplated in this respect. Group A is present on group R and is utilized to attach the polyoxyalkylene constituent to the organic chromophore. Nitrogen is the preferred linking moiety. The polyoxyalkylene group is generally a ethylene oxide, propylene oxide, or combinations thereof. Preferably ethylene oxide is present in the major amount, and most preferably the entire polyoxyalkylene constituent is ethylene oxide.

The preferred number of moles (n) of polyoxyalkylene constituent per polyoxyalkylene chain is from 3 to 50, more preferably from 20 to 30. Also, preferably two such polymeric chains are present on each polymeric colorant compound (x, above, is preferably 2). In actuality, the number of moles (n) per polymeric chain is an average of the total number present since it is very difficult to control the addition of specific numbers of moles of alkyleneoxy groups. The Table below lists some particularly preferred colorants for utilization within the inventive laundry bars in relation to Structure (I), above, and is not intended to limit the types of colorants available within the inventive laundry bar formulations. The degree of alkoxylation is listed as ranges (under n) due to the inexactness of applying and measuring such moieties within the final colorant products:

TABLE 1

Preferred Poly(oxyalkylenated) Colorants

| Col. # | R | A | B | n | m | x |
|---|---|---|---|---|---|---|
| 1 | Phenyl Diazo | $SO_3N$ | EO | 3–6 | 3 | 2 |
| 2 | Anthraquinone | N | 1–3 PO; 2–5 EO | 3–5 | 2 | 2 |
| 3 | Benzothiazole Diazo | N | EO | 16–20 | 2 | 1 |

TABLE 1-continued

Preferred Poly(oxyalkylenated) Colorants

| Col. # | R | A | B | n | m | x |
|---|---|---|---|---|---|---|
| 4 | Methine | N | EO (methoxy-capped) | 16–20 | 2 | 1 |
| 5 | Phenyl Diazo | N | EO | 16–20 | 2 | 1 |
| 6 | Acid Diazo | N | EO | 16–20 | 2 | 1 |

The term "laundry bar" is intended to encompass a solid composition (of any shape or configuration, but preferably of a three-dimensional rectangle) of at least one soap, detergent, surfactant, and/or tenside (as well as other components, such as builders, optical brighteners, fillers, and the like) which is utilized primarily for the purpose of handcleaning and/or handwashing garments. Such bars must be very firm to withstand the frictional pressures applied to target fabrics during cleaning (the vigorous rubbing over the target garment, for example) so as to retain its structural integrity during use. Also, the bar must not be too firm as to either overly abrade the bar or the target garment. The above-referenced U.S. Patents provide more information as to the particular laundry bars discussed herein and thus encompassed by the above definition. Specifically, such laundry bars should comprise from about 25 to 80% by weight, most preferably from about 30 to about 60% by weight (from about 15 to 40 parts) of active cleaning ingredient (i.e., soap, detergent, surfactant, tenside, or any mixtures thereof). Such amounts are extremely high as compared with standard personal cleansing bars; the utilization of such high amounts for standard hand and/or body washing would be detrimental to the user as such compounds cause skin irritation. Other than the above-mentioned colorants, the laundry bar formulation may also comprise any of the following components (in % by weight of the total composition): 30–40% of builders (such as, for example, sodium tripolyphosphate, sodium silicate, and the like), 40–50 percent of fillers and binders (such as, for example, calcium carbonate, clays, such as bentonite, sodium sulfate, starch, magnesium sulfonate, talc, and the like), and 1–10 percent of other additives (such as glycerine, paraffin wax, foam boosters, perfumes, enzymes, dye inhibitors, and antibacterial agents). Furthermore, the amount of free water within the initially produced composition preferably should not exceed about 15%. Any higher amounts will result in too soft a bar for proper utilization as a laundry bar.

Suitable soaps in this invention include any of the well known salts of fatty acids produced by combining a cation-hydroxide (as one example) with a fatty acid. Such fatty acids generally have from 8 to about 24 carbon atoms in chain length, either straight or branched, preferably from about 10 to about 20 carbons in length. Preferred cations within such salts include, without limitation, metals, such as potassium and sodium, and other components such as ammonium and alkylammonium cations. The fatty acids are preferably obtained from natural resources, such as plant or animal esters, including, without limitation, palm oil, coconut oil, peanut oil, corn oil, soybean oil, palm kernel oil, fish oil, lard, grease, tallow, castor oil, and the like. Such ingredients within the inventive laundry bars are basically the same as those listed within U.S. Pat. No. 5,952,289 to Wise et al.

The detergents, tensides, and surfactants are also standard constituents within the fabric cleaning art. Such may be derived from nonionic surfactants, anionic surfactants, cationic surfactants, amphoteric surfactants, and zwitterionic surfactants. Any alkyl- or alkenyl-groups listed below are from $C_1$ to $C_{12}$ in length unless otherwise noted. Among the nonionic surfactants are included ethoxylated or propoxylated fatty alcohols and acids, ethoxylated or propoxylated alkyl phenols, fatty acid amides, such as diethanolamides, amine oxides, phosphine oxides, polyglucosides, sulfoxides, polyoxyethylene-polyoxypropylene block copolymers, and silicon glycols. Anionic surfactants include linear or branched alkylbenzene, toluene, xylene, or naphthalene sulfonates, alkyl sulfonates and sulfates, fatty ether sulfates, ammonium ethoxysulfate, sodium ethoxysulfate, phosphate esters, alkyl and alkylenyl carboxylic acids and fatty acids (and their salts), ethoxylated alcohol sulfates, alkyl glyceryl ether sulfonates, α-sulfonated fatty acid esters, 2-acyloxyalkane-1-sulfonates, olefin and paraffin sulfonates, and β-alkoxyalkane sulfonates. Possible cationic surfactants include quaternary ammonium salts, amines, and amine oxides. Suitable amphoterics include mixed $C_8$ amphocarboxylates, cocoamphocarboxyglycinates, and derivatives of aliphatic heterocyclic secondary and tertiary amines. Suitable zwitterionics include betaines, such as cocoamidopropyl betaine, derivatives of quaternary ammonium, phosphonium, and sulfonium compounds.

Other possible components within such detergent compositions include builders/softeners, solvents, hydrotropes, pH adjusters, bleaches, bleach activators, optical brighteners, abrasives, suds boosters, suds depressors, soil suspending/release agents, anti-redeposition agents, enzymes, enzyme stabilizers, chlorine scavengers, perfumes, anti-corrosion agents, fungicides, germicides, fillers (such as smectite clays, and the like), and other colorants (such as reactive, acid, solvent, and the like dyes). Such compounds are well known within the detergent art.

Also contemplated and of particular importance within this invention is the process for manufacturing such detergent laundry bars. It has been determined that the initial laundry bar components are generally in powder form. Such components thus must be are premixed together with other liquid components, including perfumes, polymeric colorants, and water, added thereafter. After the mixing of the subsequent formulation, it is then amalgamated, milled, extruded and/or plodded under vacuum to form a solid composition, which is then cut to its desired form. Since the polymeric colorants are in liquid form, they are more versatile and easier to utilize within laundry bar manufacturing processes. Using standard bar-making equipment and well-known methods to produce the laundry bar product, the polymeric colorants can always be added at the last step of mixing process, which is much more convenient and less complex from a manufacturing perspective. The particularly preferred process comprises the following steps:

(a) admixing the soap, detergent, tenside, and/or surfactants with any other components, except the colorants;

(b) adding the desired polymeric colorants to the mixture of step "a";

(c) optionally milling the mixture from step "b" to produce flakes of the milled product;

(d) extruding the product from step "b" or step "c" to produce an elongated solid product; and (e) cutting and shaping the product from step "d" to form the desired laundry bar.

Such a simplified method of producing an actual colored laundry bar is highly desirable from a complexity standpoint and permits a reduction in cost for the producer and ultimately the user.

PREFERRED EMBODIMENTS OF THE INVENTION

As mentioned above, the laundry bar compositions of the present invention are characterized by significantly reduced staining of fabric. Fabric staining may be determined by measuring the ΔE cmc value of the residue colorant stain on a target substrate. This ΔE cmc value is directly related to fabric staining after laundering. The numerical value of ΔE cmc as is determined in this invention can vary from 0 to 5; preferably from 0 to about 1.

As one example, the stain on cotton terry fabric, which has a very rough surface, may be measured by rating the residue stain visually. The numerical value for the staining on cotton terry, on a scale of zero to 10, as determined in this invention can vary from 0 to 2; preferably from 0 to about 1.

The following examples serve to illustrate the subject matter of the present invention and are not to be construed as limiting the scope of the invention. All parts and percentages that are set forth are by weight unless otherwise indicated.

All of the preferred embodiments below comprised the following laundry bar base material components in the amount listed by parts:

BASE MATERIAL COMPOSITION

| Component | Amount in Parts |
|---|---|
| $C_9$–$C_{18}$ alkyl benzene sulfonate | 19 |
| Soap (sodium salt of $C_{12}$–$C_{18}$ fatty acid) | 10 |
| Sodium tripolyphosphate | 14 |
| Sodium Carbonate | 22 |
| Sodium Silicate | 7 |
| Starch | 10 |
| Magnesium Sulfate | 4 |
| Water | 14 |

EXAMPLE 1

5 gm of a 20%/80% mixture of Colorants #1 and #2 from TABLE 1, above was added to 10 kg of non-colored laundry bar base material in a ribbon mixer and blended for a short length of time to adequately disperse them in the mixture to produce a uniformly green colored material (the concentration of the colorant to base material was about 0.2%). The mixture is fed through roll mills to provide more intimate mixing. Roll mills used for this purpose are those typical of soap milling process. The milled product was then extruded by the plotter from Sunlab International to form a homogeneous bar.

EXAMPLES 2–4

The following polymeric colorants or their blends (at the concentration of 0.05, 0.1, 0.2 and 0.3 %, respectively) were mixed with the non-colored laundry bar base material by using standard bar-making equipment as mentioned in Example 1.

TABLE 2

| Example # | Type of Colorant(s) | Conc. of Colorant | Color |
|---|---|---|---|
| 2 | 50%/50% mixture of Colorants #2 and #3 | 0.05% | Purple |

TABLE 2-continued

| Example # | Type of Colorant(s) | Conc. of Colorant | Color |
|---|---|---|---|
| 3 | Colorant #2 | 0.05% | Blue |
| 4 | Colorant #2 | 0.1% | Dk Blue |

Commercially available comparative laundry bars were tested for stability and staining as discussed below.

Stain Measurements for Examples and Comparatives

100% cotton 2.94 combed broadcloth (from TestFabrics, Incorporated) with the dimensions measuring 10 cm by 10 cm was prewashed, dried, and ironed based on the protocol of the process described in Test Method ASTM D 4265. A 100% cotton terry cloth (from Test Fabrics, Incorporated) with the dimensions measuring 10 cm by 4 cm was also prepared by the same protocol for further testing.

The sample cloth pieces were individually pre-immersed in water for 5 minutes to thoroughly wet the fabric. The fabric was taken out from the water and scrubbed with the laundry bar sample till it was fully covered with soap on both sides. These samples were individually kept at room temperature inside enclosed plastic bags for 24 hours before being was washed and rinsed with water until the rinse water exhibited no visible color. Finally, the testing fabrics sample were dried at room temperature. The above testing procedure can also be repeated for multi-cycle washability tests, if desired.

The cotton terry samples were placed side-by-side for comparisons. The cotton broadcloth fabrics were smoothed with a steam iron for further measurements.

After the washing procedures were then completed, the samples were analyzed for residual staining using CIELAB coordinates measured by means of an Ultrascan™ XE color computer from Hunterlab. The color computer was adjusted to the following settings:

1. 10 degree viewer
2. D65 illuminant
3. ½ inch diameter viewing aperture
4. UV filter The instrument was then calibrated to zero reflectance with a black tile and 100% reflectance with a white tile. Both the control (white fabric) and the stained test samples were evaluated according to the following procedure: Each fabric test sample was folded lengthwise and widthwise to present a four-fold thickness of fabric to be inserted into the light source of the instrument. A white tile was then placed over the fabric sample and the CIELAB data was obtained from the color computer. ΔEcmc data was used as an indication for any residual staining of the test and comparison fabric samples. The residual stain on the sample fabric was then rated on a scale of 0 to 10. The following guidelines below are used to give a numeric value to the staining on cotton terry fabrics:

0 - - - No stain apparent on the fabric

1 - - - Slight stain apparent, approximately 10% depth of original

2 - - - Slight stain apparent, approximately 20% depth of original

3 - - - Moderate stain, approximately 30% depth of original

4 - - - Moderate stain, approximately 40% depth of original

5 - - - Moderate stain, approximately 50% depth of original

6 - - - Severe stain, approximately 60% depth of original

7 - - - Severe stain, approximately 70% depth of original

8 - - - Severe stain, approximately 80% depth of original

9 - - - Severe stain, approximately 90% depth of original

10 - - - 100% of original stain remaining

The comparative samples tested in this experiment were the following with the actual color and source listed (these were all either dyestuff or pigment-based colored laundry bars):

Comparative A—Trojan® (Green, from Colgate-Palmolive)

Comparative B—Dobi® (purple, from Lion)

Comparative C—Trojan® (Blue, from Colgate-Palmolive)

Comparative D—Fab® Total (Dark Blue, from Colgate-Palmolive)

The results of Experimental Table below illustrate typical washability (on 100% cotton) of the commercial laundry bar samples mentioned above as compared with those from the samples with similar shade and color depth made by using the polymeric colorants (Examples 1–4, above).

Experimental Table 1
Stain Data for both commercial laundry bar and the samples from polymeric colorants on 100% cotton fabric

| Color shade | Sample | Delta E cmc First Cycle | Delta E cmc Second Cycle |
|---|---|---|---|
| Green | Comparative A | 0.42 | 3.44 |
| | Example 1 | 0.21 | 0.37 |
| Purple | Comparative B | 1.05 | 2.15 |
| | Example 2 | 0.47 | 1.22 |
| Blue | Comparative C | 1.06 | 2.28 |
| | Example 3 | 0.94 | 1.35 |
| Dark Blue | Comparative D | 1.59 | 4.36 |
| | Example 4 | 0.72 | 1.29 |

The results clearly evince the superior properties of the inventive laundry bars in comparison with the commercially available types comprising dyestuffs, pigments, or mixtures thereof The results of Experimental Table 2 illustrate the washability test results on cotton terry.

Experimental Table 2
Stain Data for both commercial laundry bars and the samples from polymeric colorants on cotton terry

| Color shade | Sample | Stain scale |
|---|---|---|
| Green | Comparative A | 2 |
| | Example 1 | 1 |
| Purple | Comparative B | 3 |
| | Example 2 | 1 |
| Blue | Comparative C | 3 |
| | Example 3 | 1 |
| Dark Blue | Comparative D | 4 |
| | Example 4 | 1 |

The polymeric colorants illustrated in above two tables clearly provided superior staining properties over the commercial laundry bars shown in above tables. Generally, the fabric (both 100% cotton and cotton terry) staining was as much as 3–4 times better for the polymeric colorants of the above tables.

While specific features of the invention have been described, it will be understood, of course, that the invention is not limited to any particular configuration or practice since modification may well be made and other embodiments of the principals of the invention will no doubt occur to those skilled in the art to which the invention pertains. Therefore, it is contemplated by the appended claims to cover any such modifications as incorporate the features of the invention within the true meaning, spirit, and scope of such claims.

What is claimed is:

1. A laundry bar comprising at least one cleaning compound selected from the group consisting of a soap, a detergent, a surfactant, and any mixtures thereof and from about 0.001 to about 2.0% by weight of the total weight of the bar of at least one polymeric colorant having from about 3 to 50 moles of oxyalkylene monomers per polyoxyalkylene-containing chain, and wherein said at least one polymeric colorant is water soluble.

2. The laundry bar of claim 1 wherein said at least one cleaning compound is present in an amount of from about 25 to about 80% by weight of the total weight of the bar.

3. The laundry bar of claim 2 wherein said at least one cleaning compound is present in an amount of from about 30 to about 60% by weight of the total weight of the bar.

4. The laundry bar of claim 1 wherein the amount of water present within the bar is at most 15%.

5. The laundry bar of claim 2 wherein the amount of water present within the bar is at most 15%.

6. The laundry bar of claim 3 wherein the amount of water present within the bar is at most 15%.

7. The laundry bar of claim 1 wherein said at least one polymeric colorant exists as a liquid or a waxy paste in its pure, undiluted state at room temperature.

8. The laundry bar of claim 2 wherein said at least one polymeric colorant exists as a liquid or a waxy paste in its pure, undiluted state at room temperature.

9. The laundry bar of claim 3 wherein said at least one polymeric colorant exists as a liquid or a waxy paste in its pure, undiluted state at room temperature.

10. The laundry bar of claim 5 wherein said at least one polymeric colorant exists as a liquid or a waxy paste in its pure, undiluted state at room temperature.

11. A method of producing a colored laundry bar comprising the sequential steps of:

(a) admixing a base material composition comprising at least one cleaning component selected from the group consisting of at least one soap, at least one detergent, at least one surfactant, and any mixtures thereof; wherein said base material composition does not comprise colorants;

(b) adding at least one polymeric colorant to the mixture of step "a"; wherein said at least one polymeric colorant has from about 3 to 50 moles of oxyalkylene monomers per polymer chain and is water soluble;

(c) optionally milling the mixture from step "b" to produce flakes of the milled product;

(d) extruding the product from step "b" or step "c" to produce an elongated solid product; and (e) cutting and shaping the product from step "d" to form the desired laundry bar.

12. The method of claim 11 wherein said at least one cleaning component is present in an amount of between about 25 and 80% by weight of the total weight of the bar of step "e".

13. The method of claim 12 wherein said at least one cleaning component is present in an amount of between about 30 and 60% by weight of the total weight of the bar of step "e".

14. The method of claim 11 wherein said at least one cleaning component is present in an amount of between about 25 and 80% by weight of the total weight of the bar of step "e".

15. The method of claim 11 wherein the amount of water present within the bar of step "e" is at most 15%.

16. The method of claim 12 wherein the amount of water present within the bar is at most 15%.

17. The method of claim 11 wherein said at least one polymeric colorant exists as a liquid or a waxy paste in its pure, undiluted state at room temperature.

18. The method of claim 12 wherein said at least one polymeric colorant exists as a liquid or a waxy paste in its pure, undiluted state at room temperature.

19. The method of claim 13 wherein said at least one polymeric colorant exists as a liquid or a waxy paste in its pure, undiluted state at room temperature.

20. The method of claim 15 wherein said at least one polymeric colorant exists as a liquid or a waxy paste in its pure, undiluted state at room temperature.

* * * * *